US005964575A

United States Patent [19]

Marey

[11] Patent Number: 5,964,575

[45] Date of Patent: Oct. 12, 1999

[54] APPARATUS FOR VENTILATING A TURBINE STATOR RING

[75] Inventor: Daniel Jean Marey, Soisy S/Seine, France

[73] Assignee: Societe Nationale d'Etude et de Construction de Moteurs d'Aviation "SNECMA", Paris, France

[21] Appl. No.: 09/115,695

[22] Filed: Jul. 15, 1998

[30] Foreign Application Priority Data

Jul. 24, 1997 [FR] France ..... 97 09399

[51] Int. Cl.[6] ..... F01D 5/14

[52] U.S. Cl. ..... 415/115; 415/116; 415/173.1; 415/176; 415/178

[58] Field of Search ..... 415/115, 116, 415/173.1, 173.2, 176, 178

[56] References Cited

U.S. PATENT DOCUMENTS

| | | | |
|---|---|---|---|
| 3,703,808 | 11/1972 | Stearns | 60/39.66 |
| 3,825,364 | 7/1974 | Halila et al. | 415/116 |
| 3,844,343 | 10/1974 | Burggraf | 165/109 |
| 4,157,232 | 6/1979 | Bobo et al. | 415/116 |
| 5,048,288 | 9/1991 | Bessette et al. . | |

FOREIGN PATENT DOCUMENTS

| | | | |
|---|---|---|---|
| 0 515 130 | 11/1992 | European Pat. Off. . | |
| 2 407 343 | 5/1979 | France . | |
| 2116639 | 9/1983 | United Kingdom | 415/116 |

*Primary Examiner*—Edward K. Look
*Assistant Examiner*—Matthew T. Shanley
*Attorney, Agent, or Firm*—Oblon, Spivak, McClelland, Maier & Neustadt, P.C.

[57] ABSTRACT

This ventilation apparatus uses gas under pressure diverted from a cooler area of the turbine that reaches a chamber and (8) successively passes through a cover (6) perforated with flow-restricting apertures (13), and then a wall (7) perforated with distribution apertures (12) before reaching a stator ring exposed to the heat that must be cooled, that economizes the ventilation gas due to the almost unperforated cover (6). This construction can be fitted to high pressure turbine stator rings. The cover and the wall form a single unit and the apertures restricting the flow are in the form of nozzles opening into the volume formed by the unit.

3 Claims, 2 Drawing Sheets

APPARATUS FOR VENTILATING A TURBINE STATOR RING

The present invention relates to an apparatus for ventilating a turbine stator ring.

Such systems are already widely used to cool certain components of turbines subject to considerable heating, particularly stator stator rings of high pressure turbines, where the temperature can reach approximately 1500° C. Ventilation gas under pressure is taken from a cooler area of the machine and flows through a pipe ending in a plenum chamber located behind the stator ring to be cooled. The gas flows around the stator ring and takes up its heat before leaving the chamber via exit apertures cut in the stator ring or adjacent sections of the machine and feeds into the gas flow or goes to cool another stator ring.

The problem the inventors address here is the machine's loss of efficiency caused by loss of the ventilation flow. In order to achieve efficient ventilation, the flow must be restricted to the necessary minimum. The proposed solution consists in installing an annular distributor in the chamber behind the stator ring into which the gas supply pipe opens. The annular distributor comprises a wall perforated with apertures and a perforated cover located between the wall and used to limit the gas flow. There are fewer apertures in the cover than in the wall and they have a smaller total cross-section.

The cover and the wall cut successively across the chamber thus forcing the ventilation gas to flow successively through them before reaching the chamber to be cooled. The main purpose of the perforated wall is to disperse the ventilation gas appropriately over the various sections of the stator ring. Many examples of this can be found in the prior art including U.S. Pat. No. 5,273,396 and French patent 2 416 345. The latter is of particular interest here as it comprises a cover similar to that of the present invention. The cover of the first patent referred to is simply used, however, to fasten the wall to the surface of the chamber and consists of an assembly of lateral flanges that surround the recesses under which the perforated wall is installed. Clearly, the recesses have no effect on the flow of the ventilation gas. In contrast, the cover of the second patent is unperforated and is only used to reduce the volume of the gas flow chamber. The gas enters via lateral apertures made through the stator ring. The design is different and, once again, the apertures are not intended to restrict the gas flow.

It is another aim of the present invention to construct a light, low-cost distributor that can be entirely built before being installed in the plenum chamber and fastened--to its surface. To achieve this, the distributor is in the form of a unit consisting of the perforated wall and the cover that are form a single volume and the ventilation gas must pass through before reaching the annex to be ventilated. Furthermore, the cover apertures are disposed on projections formed by forcing the material of the cover towards the outside of the unit to form nozzles that give onto the perforated wall.

The manner in which the cover is perforated will not be described in detail; it consists in using a punch to create holes, in ways known to those skilled in the art, before fastening it to the perforated wall to form the unit. What is essential is that the perforations thus obtained should widen towards the unit and are elongated, thus explaining why they are known as "nozzles". They have the advantage of reducing the speed of the ventilation gas entering the unit, increasing its pressure and making it flow more easily, thus contributing to it being evenly dispersed towards the apertures of the wall.

The nature of the invention, its general structure and the advantages particular to some of its embodiments will now be described in greater detail using the following figures.

Figure 1:
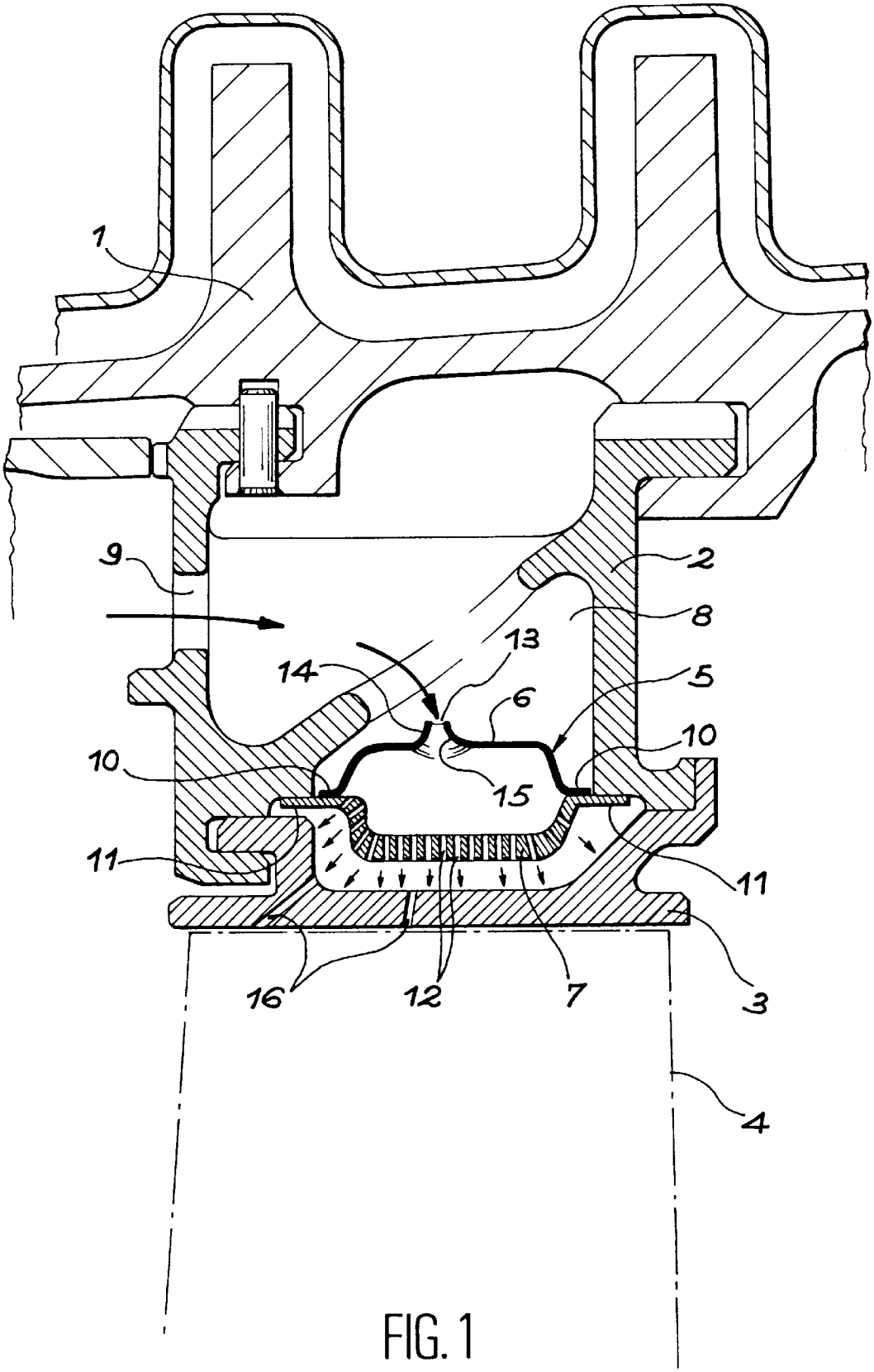
FIG. 1 shows a turbine stator ring fitted with the invention.

A turbine stator 1 is fitted with spacers 2 (of which only one is shown) each of which bears a stator rings 3 that contributes to limiting the gas flow of the turbine in front of the circular stages of mobile rotor blades 4. The subject of the invention is an annular unit 5 comprising a cover 6 and a wall 7. Unit 5 is housed in a chamber 8 defined by the spacer 2 and the stator ring 3 -and it cuts through the chamber between the stator ring 3 and the opening 9 of a circuit supplying relatively cool gas originating at the bottom of the combustion chamber. The rest of the supply circuit is not shown as it is not original, but the above-mentioned French patent 2 416 345 can be consulted for further detail. Unit 5 is constructed by fitting the cover 6 and wall 7 with circular lateral flanges 10 and 11 of the same diameter and joining them together by welding, rivets or other means. The lateral flanges 11 of the wall 7 are fastened to spacer 2.

Wall 7 is perforated i.e. provided with numerous apertures 12 that are slightly longer than they are wide due to their small diameter and the considerable thickness of the wall 7. Cover 6 is perforated with other apertures 13, that are fewer in number than the apertures 12 of wall 7 but whose cross-section is also relatively small. They are located on top of projections 14 obtained by forcing the material of cover 6 towards the outside of unit 5; their shape is more or less conical so that apertures 13 communicate with the inside of unit 5 via nozzles 15 that open onto wall 7.

Figure 2:
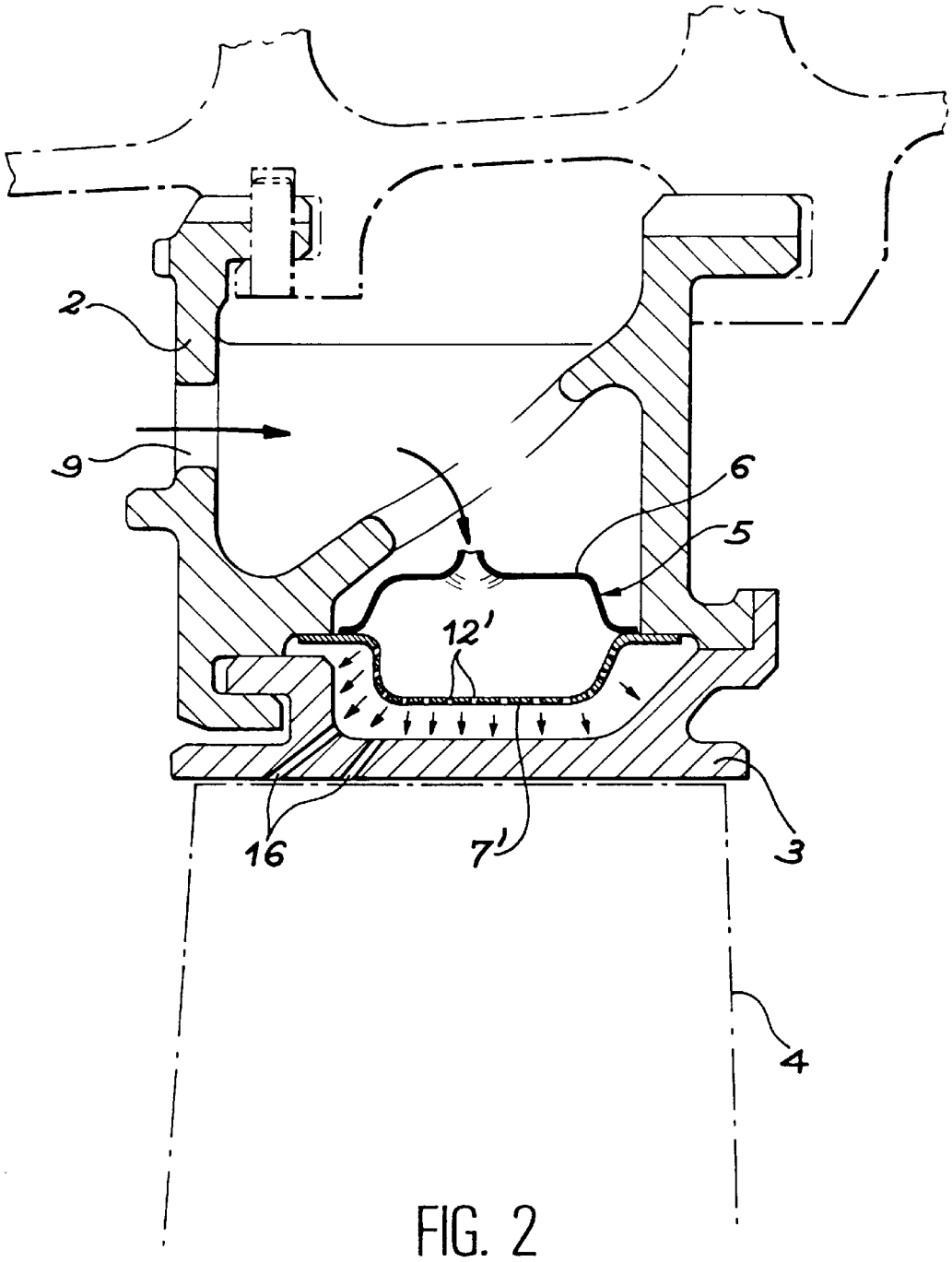
FIG. 2 shows another embodiment of the invention.

Gas entering chamber 8 accumulates in front of unit 5 and flows through apertures 13 then 12 and flows onto stator ring 3 before being evacuated into the gas flow by passing through apertures 16 in stator ring 3. The size of apertures 13 is precisely dimensioned to restrict the gas flow passing through them; however, the shape of the nozzles 15 acts to prevent excessive reduction of the flow rate. The projections 14 can, however, be orientated so that the mean direction of the gas flow in unit 5 is towards one area or another of the wall 7. The gas flow is thus dispersed appropriately in unit 5 and flows from it via apertures 12 that distribute it by accurately directing and dispersing it to the appropriate sections of stator ring 3. The density and the direction of apertures 12 can therefore vary on wall 7. This type of construction of the wall is not, however, always necessary and the simpler, lighter wall of FIG. 2 may be preferred. In this figure the thick wall 7 has been replaced by a wall 7' that is as thin as cover 6. The remaining description is valid, except that apertures 12', that can still provide the same dispersion as apertures 12, are much shorter and have no noticeable effect on the direction of the gas flow. Therefore, the only way of adjusting how the cooling effect of this construction is distributed is by adjusting the density of the apertures 12'.

Restricting the ventilation gas flow is only achieved provided the total cross-section of apertures 13 of cover 6 is smaller than that of apertures 12 of wall 7. The risk involved in excessively reducing the number of apertures 12 is that irregularities in the cooling of stator ring 3 may occur. It can be seen that the gas flow may be reduced even if there are a large number of apertures 12 in wall 7.

Finally, the design of the present invention can certainly be applied to other areas of the machine apart from high pressure turbine stator rings, and it can also be used with gas that heats the structure onto which it is blown.

I claim:

1. Apparatus for ventilating a turbine stator ring (3) comprising a supply circuit (9) of ventilation gas originating at another area of the turbine and opening into a chamber (8) behind stator ring (3), chamber (8) being divided by an annular distributor comprising a wall (7) perforated with apertures (12) between stator ring (3) and the circuit (9), characterized by the fact that the distributor is a unit (5) that comprises a cover (6) located between the wall (7) and the circuit (9) and perforated with apertures (13) to restrict the gas flow, apertures (13) of the cover being fewer in number, having a smaller total cross section than apertures (12) of the wall, and being disposed on projections (14) obtained by forcing the material of the cover (6) towards the outside of unit (5) and forming nozzles (15) that open towards the wall.

2. Ventilation apparatus according to claim 1, characterized by the fact that the wall (7) is slightly thicker than the cover (6) and the apertures (12) in the wall are longer than they are wide.

3. Ventilation apparatus according to claim 1, characterized by the fact that the cover and the wall are joined by pairs of circular lateral flanges (10, 11) of the same diameter.

* * * * *